US008847759B2

(12) United States Patent
Bisesti et al.

(10) Patent No.: US 8,847,759 B2
(45) Date of Patent: Sep. 30, 2014

(54) MERCHANDISE DISPLAY SECURITY DEVICE INCLUDING MEANS FOR RETAINING POWER ADAPTER CORD

(75) Inventors: Robert Bisesti, Charlotte, NC (US); Kai-Sheng Cheng, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 300 days.

(21) Appl. No.: 13/294,350

(22) Filed: Nov. 11, 2011

(65) Prior Publication Data

US 2012/0120571 A1 May 17, 2012

Related U.S. Application Data

(60) Provisional application No. 61/414,072, filed on Nov. 16, 2010.

(51) Int. Cl.

| | |
|---|---|
| ***H01R 35/04*** | (2006.01) |
| ***H01R 13/58*** | (2006.01) |
| ***G08B 13/14*** | (2006.01) |
| *H01R 24/68* | (2011.01) |
| *H01R 35/00* | (2006.01) |
| *E05B 73/00* | (2006.01) |
| *H01R 24/60* | (2011.01) |
| *H01R 33/97* | (2006.01) |
| *H01R 24/66* | (2011.01) |
| *H01R 24/62* | (2011.01) |
| *H01R 35/02* | (2006.01) |

(52) U.S. Cl.

CPC ..... *E05B 73/0082* (2013.01); *H01R 13/5841* (2013.01); *H01R 24/68* (2013.01); *H01R 35/00* (2013.01); *E05B 73/0005* (2013.01); *H01R 24/60* (2013.01); *H01R 33/973* (2013.01); *H01R 24/66* (2013.01); *H01R 33/97* (2013.01); *H01R 24/62* (2013.01); *H01R 33/971* (2013.01); *G08B 13/1463* (2013.01); *H01R 35/02* (2013.01); *H01R 35/04* (2013.01)

USPC ..... 340/568.1; 340/568.2; 340/568.3; 340/568.4; 340/571; 439/10; 439/13; 439/109; 439/177; 439/258

(58) Field of Classification Search

CPC ..... H01R 24/38; H01R 24/60; H01R 24/62; H01R 24/66; H01R 24/68; H01R 33/97; H01R 33/971; H01R 33/973; H01R 35/00; H01R 35/02; H01R 35/04

USPC ..... 340/568.1, 568.2, 568.3, 568.4, 568.8, 340/571; 439/10, 13, 109, 177, 258, 312, 439/324

See application file for complete search history.

(56) References Cited

U.S. PATENT DOCUMENTS

| | | | | |
|---|---|---|---|---|
| 5,146,205 | A | 9/1992 | Keifer et al. | |
| 6,027,277 | A | 2/2000 | Leyden et al. | |
| 6,039,498 | A | 3/2000 | Leyden et al. | |
| 7,209,038 | B1 * | 4/2007 | Deconinck et al. | 340/568.8 |
| 7,327,276 | B1 | 2/2008 | Deconinck et al. | |
| 7,503,809 | B2 * | 3/2009 | Tsai et al. | 439/668 |
| 2007/0194918 | A1 | 8/2007 | Rabinowitz et al. | |
| 2008/0168806 | A1 | 7/2008 | Belden et al. | |
| 2009/0033492 | A1 | 2/2009 | Rapp et al. | |

OTHER PUBLICATIONS

Lee, Jeong Ho, International Search Report and Written Opinion of the International Searching Authority, Apr. 25, 2012, pp. 1-9, Korean Intellectual Property Office, Republic of Korea.

"Instructions for the PowerPro Sensor Head Cameras and Camcorders (Power and Security)", 2007, 10 pages, Protex International Corp., Bohemia, New York, USA.

* cited by examiner

*Primary Examiner* — Daniel Wu
*Assistant Examiner* — Benyam Haile
(74) *Attorney, Agent, or Firm* — InVue Security Products Inc.

(57) ABSTRACT

A merchandise display security device for displaying and protecting an article of merchandise includes means for retaining a power adapter cord on a sensor housing when the article of merchandise is attached to the sensor housing. The sensor housing includes a body configured for attachment to the article of merchandise and a power output port. A shelf adjacent the power output port includes an outer wall that defines a groove for receiving and retaining a portion of the power adapter cord. The portion of the power adapter cord is disposed within the groove and rotatable between an engaged, but uncoupled position in which the article of merchandise cannot be readily attached to the sensor housing and an engaged and coupled position in which the article of merchandise can be attached to the sensor housing and the power adapter cord is retained on the sensor housing.

24 Claims, 7 Drawing Sheets

MERCHANDISE DISPLAY SECURITY DEVICE INCLUDING MEANS FOR RETAINING POWER ADAPTER CORD

CROSS REFERENCE TO RELATED APPLICATION

This non-provisional application claims the benefit of U.S. Provisional Application No. 61/414,072 filed on Nov. 16, 2010, the disclosure of which is incorporated herein by reference in its entirety.

FIELD OF THE INVENTION

This invention relates generally to merchandise display security systems for displaying and protecting an article of merchandise from theft. More particularly, the invention is a merchandise display security device including means for retaining a power adapter cord that provides power to an article of merchandise attached to the device. In one embodiment, a merchandise display security device includes a sensor housing configured for receiving a power adapter cord having a first end electrically connected to an article of merchandise attached to the sensor housing and a second end electrically connected to the sensor housing with the power adapter cord being retained on the sensor housing when the article of merchandise is attached to the sensor housing, thereby preventing unauthorized removal or theft of the power adapter cord.

BACKGROUND OF THE INVENTION

Retailers routinely display relatively small, relatively expensive, handheld electronic merchandise, such as mobile (e.g. cellular) telephones, iPods, game consoles, personal data assistants (PDAs), and the like, for customers to examine before making a purchase. Retailers often desire the handheld electronic merchandise to be powered as well so that a potential purchaser can test the operation and functions of the merchandise. At the same time, the retailer does not want the article of merchandise to be stolen or removed from the display area by an unauthorized person. Accordingly, the article of merchandise being displayed is attached to a merchandise display security device that monitors and protects the article of merchandise from removal or theft. Such a merchandise display security device typically includes a sensor housing to which the article of merchandise is attached that houses a sensor for monitoring whether the article of merchandise remains attached to the sensor housing. In the event that the article of merchandise is detached from the sensor housing, an audible or visible alarm is activated to alert store personnel to the situation.

As such, merchandise display security devices for displaying and protecting a powered article of merchandise are known. However, the known devices are not configured to prevent the unauthorized removal or theft of a power adapter cord that provides electrical power to the merchandise. As used herein, the term "power adapter cord" is intended to include any cable, adapter (also commonly referred to as a "pigtail") or cord containing one or more conductors for providing electrical power to a handheld electronic article of merchandise, for example a mobile (cellular) telephone. The power adapter cord functions to power the handheld electronic merchandise, or alternatively, to charge an internal battery that powers the article of merchandise in the absence of an external power source (including an internal power source of the merchandise display security device). Typically, the power adapter cord has a connector at one end configured to be mated with a male plug or female jack provided on the article of merchandise, for example a micro-USB plug or jack, and a connector at the other end configured to be mated with a male plug or female jack provided on the sensor housing.

Merchandise display security devices including a tether cable are known for monitoring and preventing the unauthorized removal or theft of an article of merchandise from a prescribed area. For example, U.S. Pat. No. 6,027,277 issued Feb. 22, 2000, to Leyden et al. and U.S. Pat. No. 6,039,498 issued Mar. 21, 2000, to Leyden et al. each disclose a merchandise display security system for displaying an article of merchandise to be monitored and protected from theft. The merchandise display security system includes a housing configured to be secured on a first surface of the article of merchandise and a stabilizing element configured to be secured on a second surface of the article that is substantially transverse to the first surface. The security device further includes a tether cable having a first end and a second end. The housing is provided with a cavity to receive an enlarged portion at the first end of the tether with the stabilizing element capturing and blocking the enlarged portion of the tether within the cavity defined by the housing. The second end of the tether may be anchored to a base, such as a support surface, or to a control unit for activating an alarm in the event that the article of merchandise is detached from the housing. The tether taught by Leyden et al., however, is used to mechanically retain the article to be monitored within a prescribed range as determined by the length of the tether, and in another embodiment, to additionally support one or more conductive elements that define conductive paths between the housing and the control unit. Thus, the tether is not a power adapter cord that electrically connects a sensor housing of a merchandise display security device with an article of merchandise attached to the sensor housing to provide electrical power to the article of merchandise.

Accordingly, there exists a need for a merchandise display security system for displaying and protecting a powered article of merchandise from theft. There exists a further, and more specific, need for a for a merchandise display security device that includes means for retaining a power adapter cord on the sensor housing. There exists a particular need for a merchandise display security device including a sensor housing configured for receiving a power adapter cord having a first end electrically connected to an article of merchandise attached to the sensor housing and a second end electrically connected to the sensor housing with the power adapter cord being retained on the sensor housing when the article of merchandise is attached to the sensor housing.

DETAILED DESCRIPTION OF EXEMPLARY EMBODIMENTS

Figure 1:
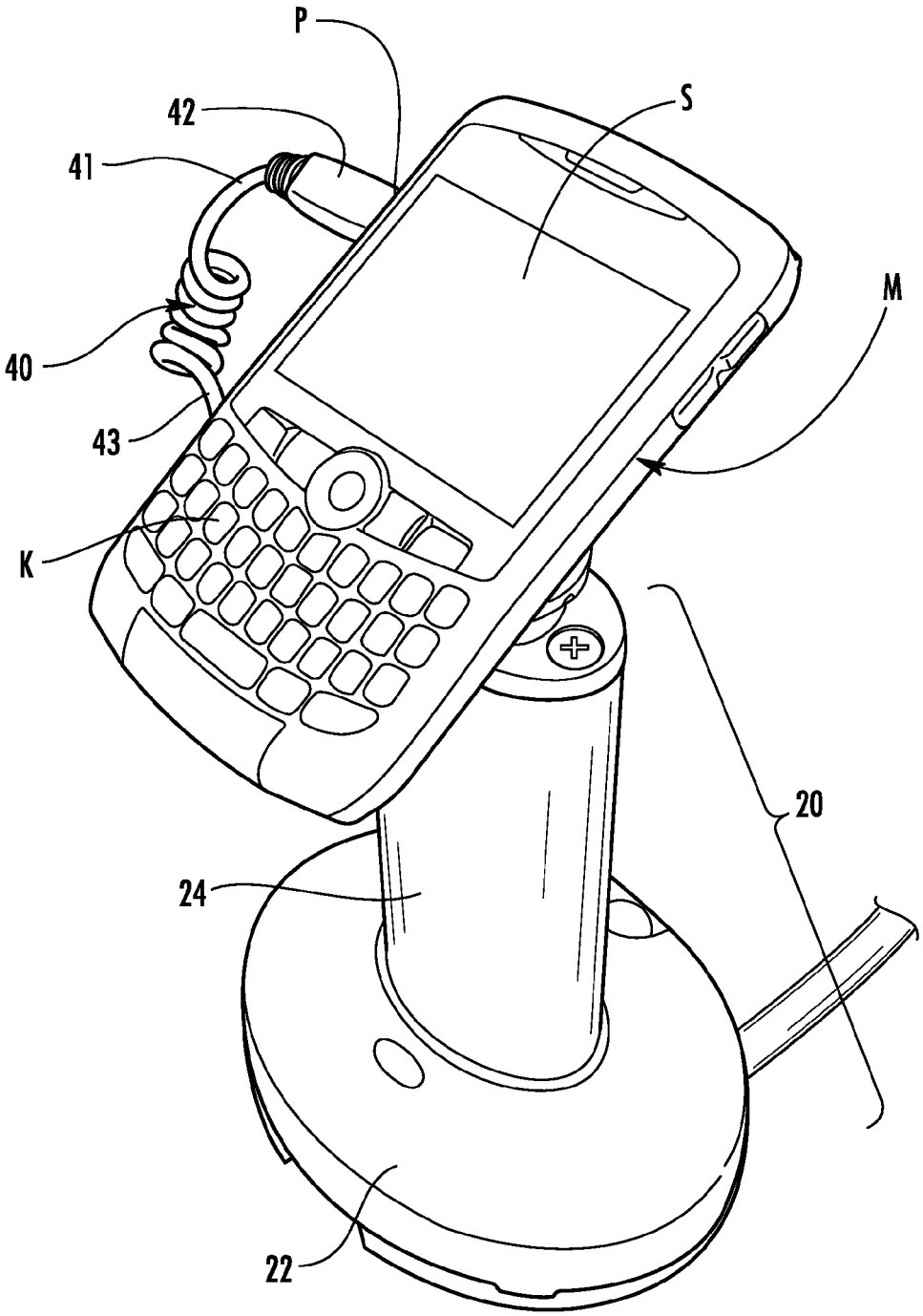
FIG. 1 is a perspective view of a merchandise display security device for displaying and protecting an article of merchandise according to the present invention illustrating a handheld electronic article of merchandise attached to a sensor housing of the security device and electrically connected to the sensor housing by a power adapter cord.

Referring now to the accompanying drawing figures wherein like reference numerals denote like elements throughout the various views, one or more exemplary embodiments of a merchandise display security system for displaying and protecting an article of merchandise from theft are shown. More particularly, each exemplary embodiment is a merchandise display security device, indicated generally by reference character 20 in FIG. 1 and FIG. 7, for monitoring whether an article of merchandise, indicated generally by reference character M, remains attached to the security device, and for activating an audible or visible alarm in the event that the article of merchandise is separated from the security device. However, the present invention is equally applicable to any merchandise display stand, module, pedestal or the like that permits a potential purchaser to examine and operate an article of merchandise in a powered state, regardless of whether the article of merchandise is attached to the display stand or whether the display stand includes an alarm. A primary objective of the present invention is to prevent the unauthorized removal or theft of a power adapter cord, indicated generally by reference character 40, that is electrically connected between a merchandise display security device 20 and an article of merchandise M. More particularly, the present invention provides a means for retaining a power adapter cord 40 on a merchandise display security device 20 when an article of merchandise M is attached to the merchandise display security device.

FIG. 1 illustrates a merchandise display security device 20 for displaying and protecting an article of merchandise M from unauthorized removal or theft from a display area, for example in a retail store. The article of merchandise M is typically a predetermined type or model of a relatively small, relatively expensive handheld electronic article of merchandise, such as a mobile (e.g. cellular) telephone, iPod, game console, personal data assistant (PDA), and the like. The article of merchandise M is attached to the merchandise display security device 20 in a manner so as to allow customers to examine and operate the merchandise before making a decision to purchase. In the exemplary embodiment shown in FIG. 1 and FIG. 7, the article of merchandise M is a conventional cellular type mobile telephone having a keypad K, a display screen S and a power input port P for receiving a power cable from an external power source, such as an AC/DC transformer commonly referred to as a "charger." The power cable has a predetermined type of connector at one end configured for electrical connection to the power input port P. In a common example, the power input port P is a female jack configured to receive a male plug, such as a conventional micro-USB plug. The power adapter cord 40 of the present invention replaces the power cable, and accordingly, has a first end 41 that is provided with the same predetermined type of connector. In the illustrated embodiment, the connector at the first end 41 of power adapter cord 40 is a micro-USB plug 42 configured to be received within the micro-USB jack (not shown) of the cellular telephone article of merchandise M. However, the present invention is intended to be construed broadly to include any known type of connector interface whether standardized or customized. It is only necessary that the power adapter cord 40 have an appropriate first connector 42 at the first end 41 to electrically connect the first end of the power adapter cord to the article of merchandise M being displayed on the merchandise display security device 20. Similarly, the second end 43 of the power adapter cord 40 is provided with a second connector 44 (FIG. 7) that is configured for electrically connecting the power adapter cord to the merchandise display security device 20.

As shown in FIG. 1, the merchandise display security device 20 comprises a base portion 22 and an optional pedestal portion 24 extending upwardly from the base portion. Typically, electronics are disposed within the base portion 22 that monitor whether an article of merchandise M is attached to the merchandise display security device 20. More particularly, the electronics monitor whether the article of merchandise M remains attached to the merchandise display security device 20 once the article of merchandise has been secured and the merchandise display security device has been armed. For example, the security device 20 may comprise a sensor housing 30 (FIG. 7) that is removably supported on the pedestal portion 24, or alternatively, directly on the base portion 22 in a known manner. In one embodiment, the sensor housing 30 has a relatively planar upper surface 31 with an opening through which a proximity switch, limit switch or the like, referred to herein generically as sensor 32 (FIG. 2), extends. A relatively planar rear surface R (FIG. 7) of the article of merchandise M is securely attached to the upper surface 31 of the sensor housing 30, for example by a relatively thin layer of an adhesive 33 (FIG. 7), such as double-sided pressure sensitive adhesive (PSA), in a known manner. If desired, the sensor housing 30 may also be provided with an elongate opening or channel 34 (FIG. 7) that extends laterally through the sensor housing for receiving a cable tie or the like (not shown) to secure the article of merchandise M to the sensor housing. Regardless, the sensor 32 engages the rear surface R of the article of merchandise M and is electrically connected to the electronics disposed in the base portion 22 of the merchandise display security device 20 either directly, or alternatively, through an electrical circuit disposed within the sensor housing 30. The status of the sensor 32 changes between an un-activated, or "non-alarming," state when the article of merchandise M is securely attached to the sensor housing 30 and an activated, or "alarming," state when the article of merchandise is separated from the sensor housing 30. Electronics may also be provided for altering the status of an electrical circuit for monitoring the state of the sensor 32 between an on, or "armed," state and an off, or "unarmed," state in a known manner. However, as previously mentioned, the merchandise display security device 20 may be merely a merchandise display stand without any sensor, monitoring or alarming features.

Importantly, the merchandise display security device 20 comprises an internal power source, or more preferably, is electrically connected to an external power source. In either case, the second connector 44 at the second end 43 of the power adapter cord 40 is electrically connected to the power source provided by the merchandise display security device 20 to provide power to the article of merchandise M through the first connector 42 at the first end 41 of the power adapter cord that is electrically connected to the power input port P provided on the article of merchandise. A merchandise display security device 20 suitable for use with the present invention is available from InVue Security Products Inc. of Charlotte, N.C., USA. Examples of suitable merchandise display security devices 20 and power adapter cords 40 for use with the present invention are shown and described in greater detail in U.S. Pat. No. 7,710,266 issued May 4, 2010, to InVue Security Products Inc., the disclosure of which is incorporated herein by reference in its entirety. As illustrated by the exemplary embodiments herein, the sensor housing 30 is physically and electrically connected to the base portion 22 of the merchandise display security device 20 through a helical coil cable 35 containing a plurality of conductors. At least some of the conductors of the helical cable 35 are electrically connected at one end to the electronics disposed within the base portion 22 of the security device 20, and are electrically connected at the other end to the sensor 32, or alternatively, to an electrical circuit disposed within the sensor housing 30. At least some of the other conductors of the helical cable 35 are electrically connected at one end to the internal power source within the base portion 22 of the security device 20, or alternatively, to the external power source, and electrically connected at the other end to a power output port 36 provided on the sensor housing 30. As will be readily appreciated by those skilled in the art, the second connector 44 at the second end 43 of the power adapter cord 40 is electrically connected to the sensor housing 30 at the power output port 36. As a result, the power adapter cord 40 both mechanically and electrically connects the article of merchandise M to the sensor housing 30.

FIGS. 2-6 show an exemplary embodiment of a sensor housing 30 and a power adapter cord 40 according to the present invention. As previously mentioned, the sensor housing 30 comprises a sensor 32 for determining whether the rear surface R of the article of merchandise M is in engagement with the upper surface 31 of the sensor housing. By way of example, the sensor 32 is a conventional biased limit switch that is electrically connect to an electrical circuit to form a closed-circuit condition when the limit switch is in a depressed position, and conversely, to form an open-circuit condition when the limit switch is biased to its extended position. Furthermore, the article of merchandise M may be attached to the sensor housing 30 by a thin layer of an adhesive (not shown), such as a double-sided pressure sensitive adhesive (PSA) and/or a cable tie extending through the elongate channel 34 formed in the sensor housing and wrapped around the article of merchandise. Regardless, the sensor housing 30 further comprises means 50 for retaining the power adapter cord 40 when the article of merchandise M is attached to the sensor housing. The sensor housing 30 may have any convenient shape and the retaining means 50 may be positioned at any desirable location around the outer periphery of the sensor housing adjacent to the upper surface 31. Typically, the upper surface 31 of the sensor housing 30 is elongate and somewhat smaller in plan form than the rear surface R of the article of merchandise M. As shown, the retaining means 50 is located on an end of the sensor housing 30 adjacent the upper surface 31 for a purpose to be described. Regardless, the retaining means 50 cooperates with the second connector 44 on the second end 43 of the power adapter cord 40 to retain the power adapter cord on the sensor housing 30 when the article of merchandise M is attached to the sensor housing.

Figure 2:
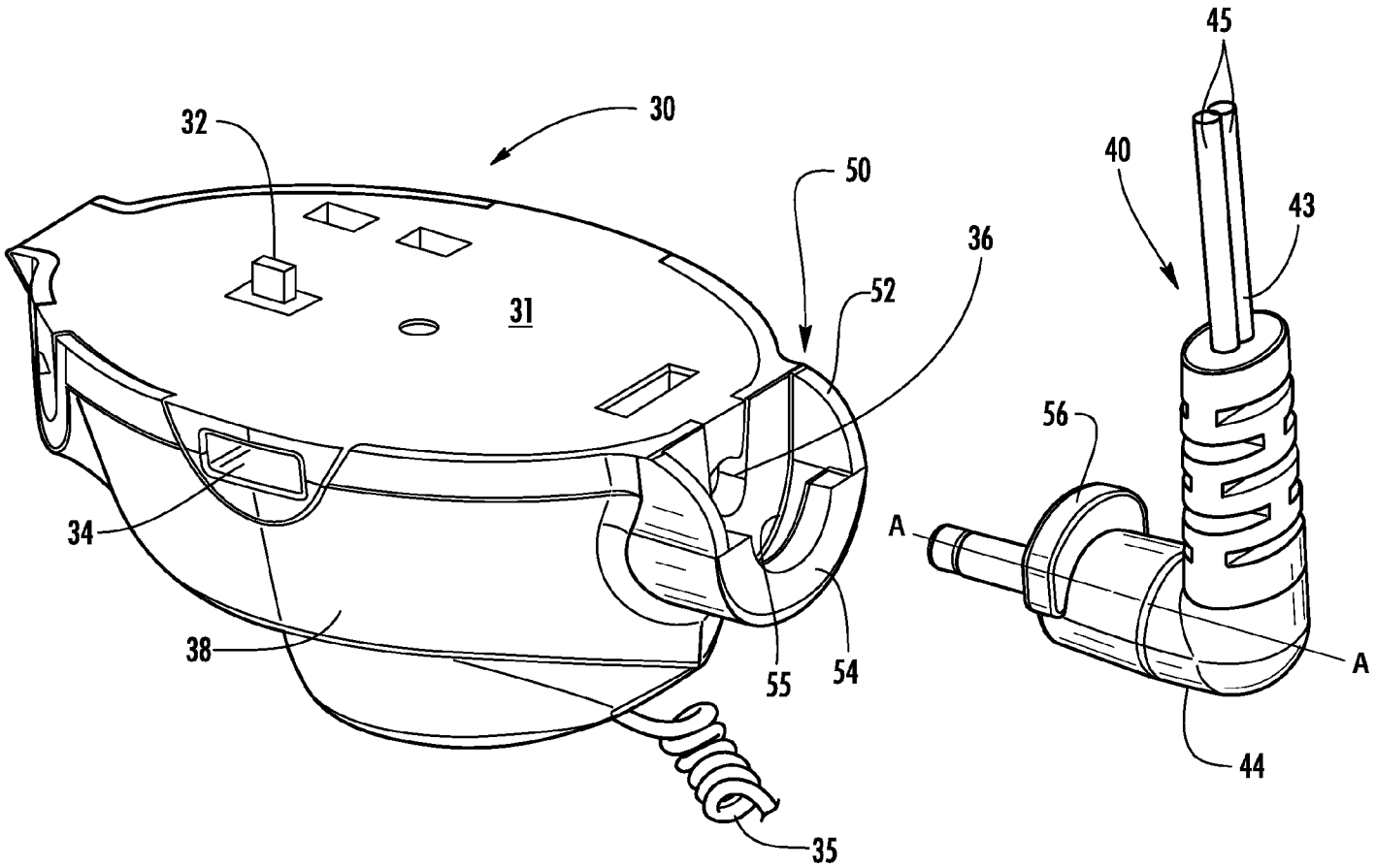
FIG. 2 is a perspective view showing the sensor housing and the power adapter cord of the merchandise display security device of FIG. 1 in a disengaged position.

FIG. 2 illustrates the sensor housing 30 and the second end 43 of the power adapter cord 40 in a disengaged position with the second end of the power adapter cord positioned opposite the retaining means 50. In the exemplary embodiment of the invention shown and described herein, the retaining means 50 comprises a shelf 52 that depends outwardly from the body 38 of the sensor housing 30 adjacent the power output port 36. Shelf 52 has a half-moon shaped outer wall 54 spaced outwardly from the body 38 of the sensor housing 30 so as to form a groove 55 between the outer wall and the body that faces towards the upper surface 31 of the sensor housing. The groove 55 is configured (i.e. sized and shaped) for receiving a corresponding lip 56 formed on the second connector 44 at the second end 43 of the power adapter cord 40. As shown herein, the second connector 44 at the second end 43 of the power adapter cord 40 is a conventional barrel-type male plug for electrically connecting to a female jack provided at the power output port 36 of the sensor housing 30. However, the conventional barrel-type second connector 44 is modified to include the half-moon shaped lip 56 protruding from one side of the outer periphery of the connector. Furthermore, the second connector 44 is shown as being L-shaped, but may be any other suitable shape, such that the power adapter cord 40 extends away from the second connector in the same radial direction that the lip 56 protrudes from the outer periphery of the connector. However, the power adapter cord 40 may extend in any radial direction relative to the second connector 44 except in a direction opposite to the direction that the lip 56 protrudes from the outer periphery of the connector. As explained in further detail below, the second connector 44 is configured to rotate about an axis of rotation "A" between an engaged, but uncoupled position and an engaged and coupled position.

Figure 3:
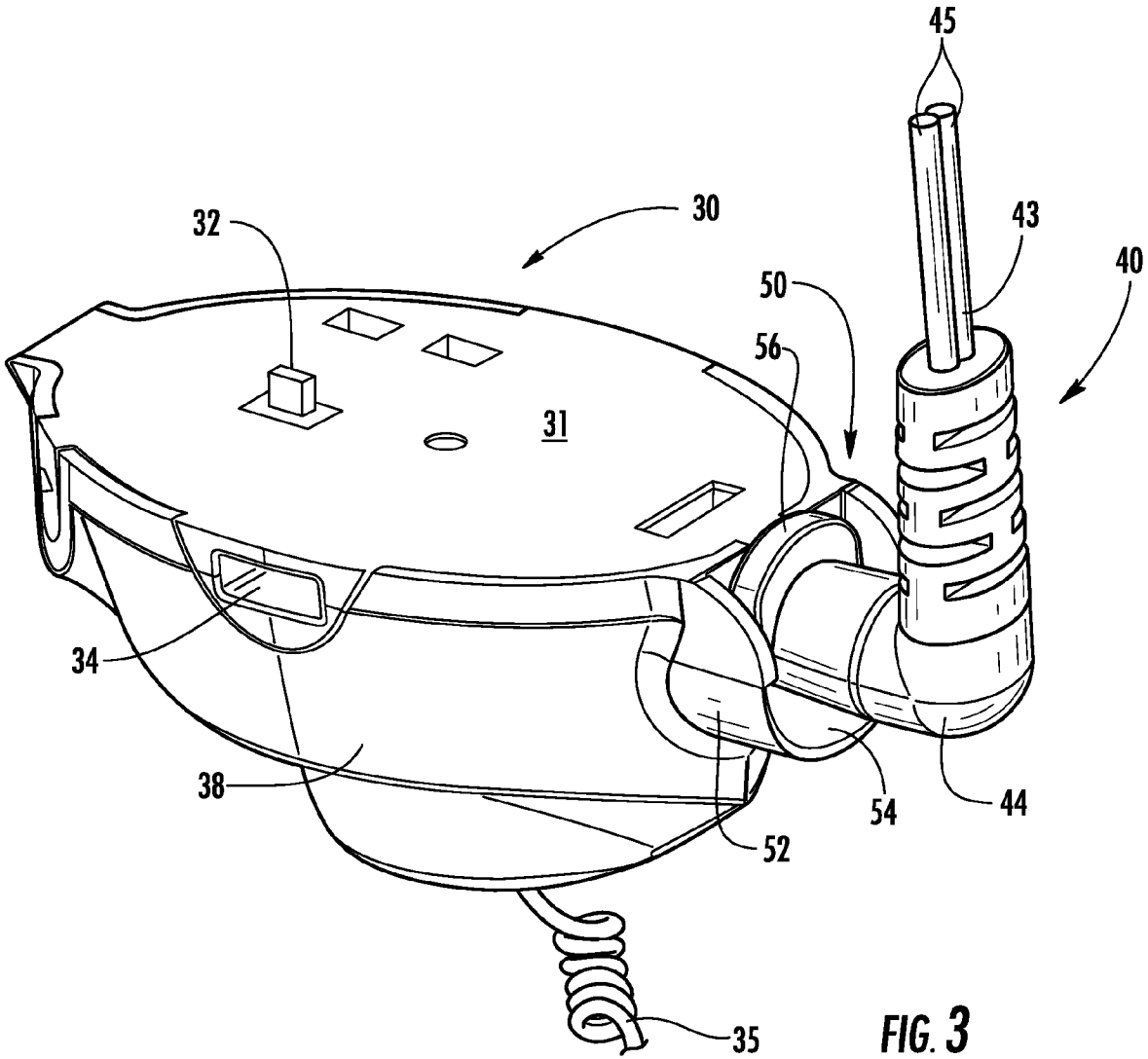
FIG. 3 is a perspective view showing the sensor housing and the power adapter cord of FIG. 2 in an engaged, but uncoupled position.

FIG. 3 illustrates the sensor housing 30 and the second end 43 of the power adapter cord 40 in an engaged, but uncoupled position. It should be noted in particular that the lip 56 formed on the second connector 44 at the second end 43 of the power adapter cord 40 extends in the direction of the upper surface 31 of the sensor housing 30. As such, the lip 56 does not cooperate with the groove 55 defined by the shelf 52 and the outer wall 54 of the retaining means 50. In this position, the conductors 45 of the power adapter cord 40 are electrically connected to conductors of the helical coil cable 35 that are electrically connected to the internal power source, or alternatively, to the external power source. Thus, electrical power would be provided to the article of merchandise M when the first connector 42 at the first end 41 of the power adapter cord 40 is engaged with the power input port P on the article of merchandise. However, the power adapter cord 40 is not retained on the sensor housing 30 by the retaining means 50. It should be further noted that the rear surface R of the article of merchandise M cannot be readily attached to the upper surface 31 of the sensor housing 30 since the power adapter cord 40 extends from the second connector 44 towards the upper surface of the sensor housing in the same direction as the lip 56. Accordingly, it is inherently counter-intuitive to attach the article of merchandise M to the upper surface 31 of the sensor housing 30 with the second connector 44 at the second end 43 of the power adapter cord 40 in the uncoupled position shown in FIG. 3.

Figure 4:
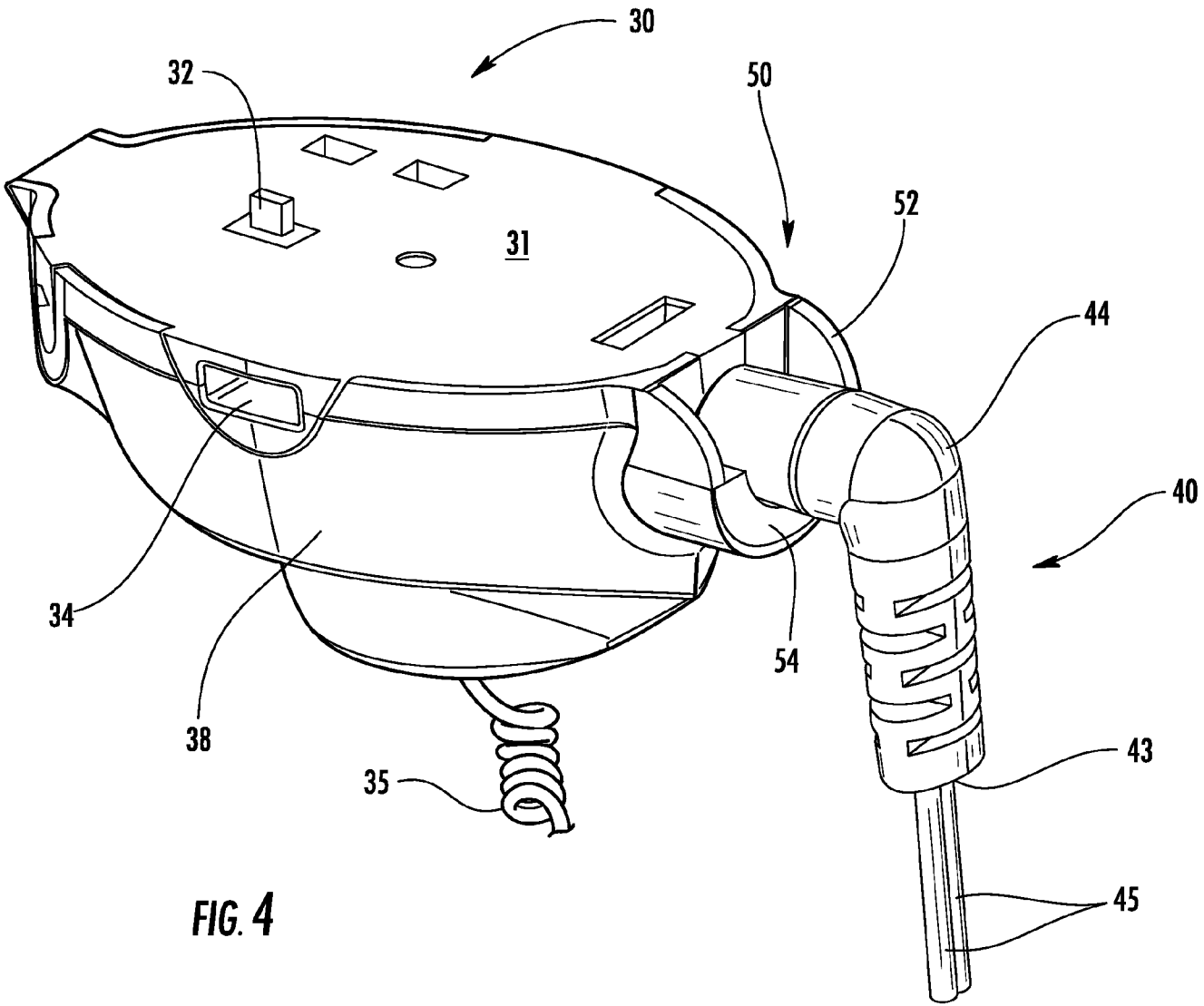
FIG. 4 is a perspective view showing the sensor housing and the power adapter cord of FIG. 2 in an engaged and first coupled position.

FIG. 4 illustrates the sensor housing 30 and the second end 43 of the power adapter cord 40 in an engaged and first coupled position. It should be noted in particular that the lip 56 formed on the second connector 44 at the second end 43 of the power adapter cord 40 extends in the direction of the groove 55 defined by the shelf 52 and outer wall 54 of the retaining means 50. As such, the lip 56 cooperates with the groove 55 to retain the power adapter cord 40 on the sensor housing 30. In this position, the second connector 44 is electrically connected to conductors of the helical coil cable 35 that are electrically connected to the internal power source, or alternatively, to the external power source. Thus, electrical power would be provided to the article of merchandise M when the first connector 42 at the first end 41 of the power adapter cord 40 is engaged with the power input port P on the article of merchandise. The power adapter cord 40 is retained on the sensor housing 30 by the retaining means 50. However, the power adapter cord 40 may be disengaged from the power output port 36 and detached from the sensor housing 30 by rotating the power adapter cord one hundred eighty degrees (180° back to the engaged, but uncoupled position of FIG. 3. For purposes of convenience only, the position of the power adapter cord 40 shown in FIG. 3 is referred to herein as the twelve o'clock position, and consequently, the position of the power adapter cord 40 shown in FIG. 4 is referred to herein as the six o'clock position. It should be noted that the rear surface R of the article of merchandise M can be readily attached to the upper surface 31 of the sensor housing 30 in the six o'clock position since the power adapter cord 40 extends from the second connector 44 away from the upper surface of the sensor housing, which in the exemplary embodiments shown and described herein is the same direction as the lip 56. Accordingly, it is inherently intuitive to attach the article of merchandise M to the upper surface 31 of the sensor housing 30 with the second connector 44 at the second end 43 of the power adapter cord 40 in the engaged and first coupled (i.e. six o'clock) position.

Figure 5:
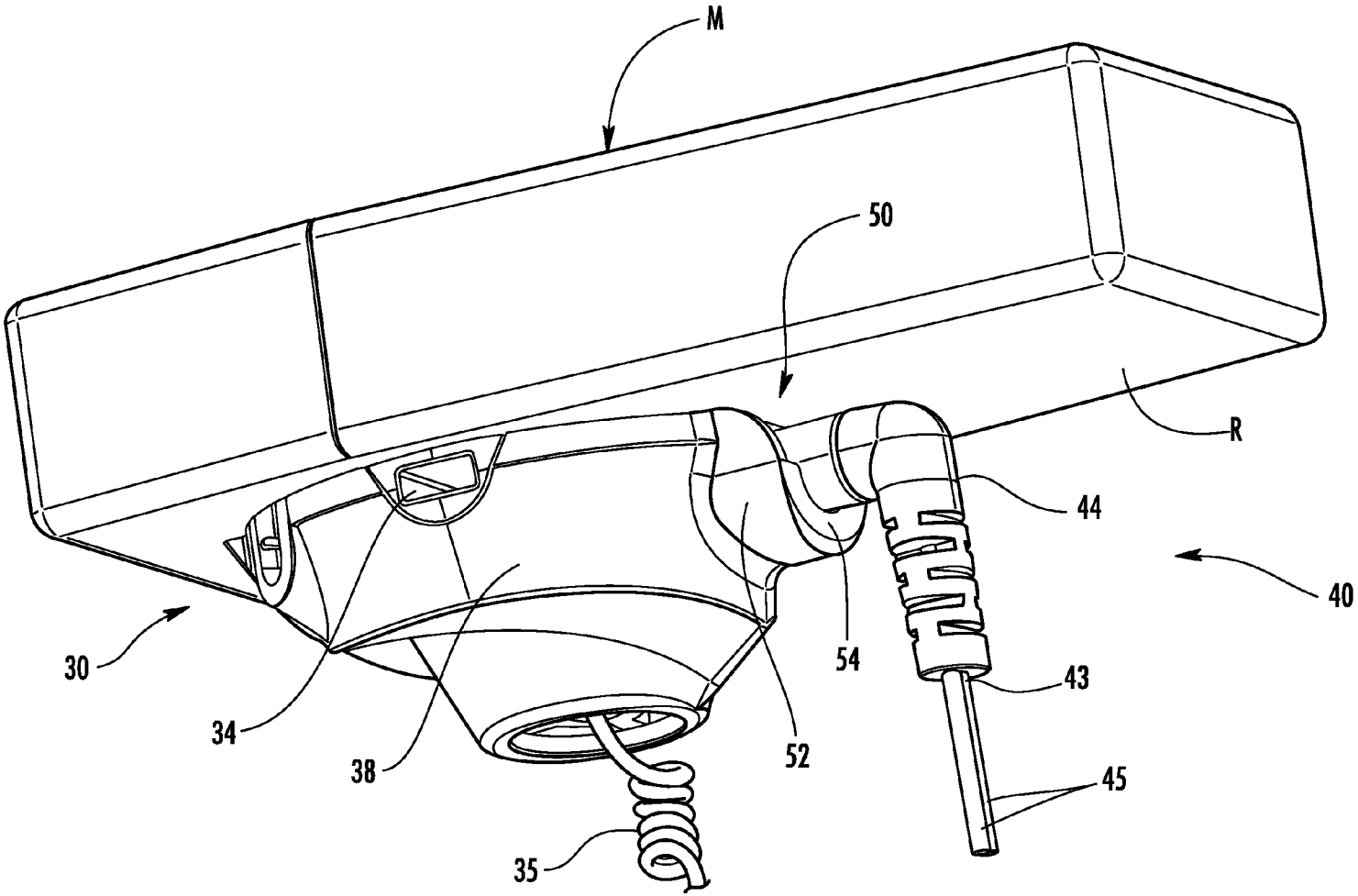
FIG. 5 is a perspective view showing the sensor housing and the power adapter cord of FIG. 2 in the engaged and first coupled position with the article of merchandise attached to the sensor housing.

FIG. 5 illustrates the sensor housing 30 and the second end 43 of the power adapter cord 40 in the engaged and first coupled position with the rear surface R of the article of merchandise M attached to the upper surface 31 of the sensor housing 30. As previously mentioned, it should be noted in particular that the lip 56 extends in the direction of the groove 55 and cooperates therewith so that the retaining means 50 retains the power adapter cord 40 on the sensor housing 30 with the article of merchandise M attached to the sensor housing. In this position, the conductors 45 of the power adapter cord 40 are electrically connected to the conductors of the helical coil cable 35, and thus to the internal or external power source, and would thereby provide electrical power to the article of merchandise M when the first connector 42 at the first end 41 of the power adapter cord 40 is engaged with the power input port P on the article of merchandise. The power adapter cord 40 is retained on the sensor housing 30 by the retaining means 50 and cannot be disengaged from the power output port 36 or decoupled from the retaining means 50 since the rear surface R of the article of merchandise M prevents the power adapter cord 40 from being rotated a full one hundred eighty degrees (180° back to the engaged, but uncoupled (i.e. twelve o'clock) position shown in FIG. 3. Accordingly, the power adapter cord 40 is "locked" onto the sensor housing 30 and the power adapter cord cannot be stolen or removed from a display area by an unauthorized person as long as the article of merchandise M remains attached to the sensor housing.

Figure 6:
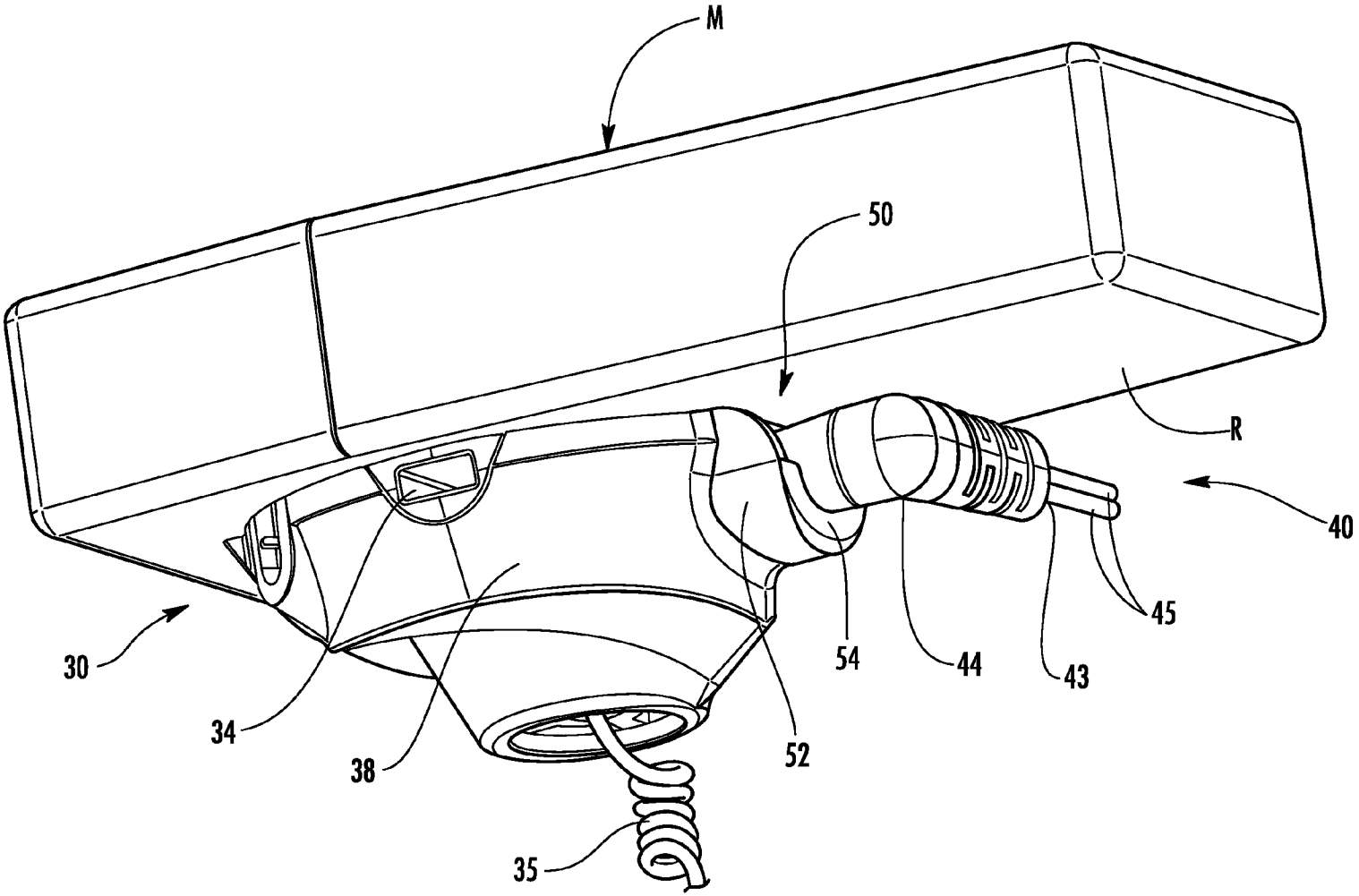
FIG. 6 is a perspective view showing the sensor housing and the power adapter cord of FIG. 2 in an engaged and second coupled position with the article of merchandise attached to the sensor housing.

FIG. 6 illustrates the sensor housing 30 and the power adapter cord 40 in an engaged and second coupled position with the rear surface R of the article of merchandise M attached to the upper surface 31 of the sensor housing. For purposes of convenience only, the position of the power adapter cord 40 shown in FIG. 6 is referred to herein as the three o'clock position, or inversely, the nine o'clock position. The three o'clock position and the nine o'clock position illustrate the limits of rotational travel of the power adapter cord 40 on the sensor housing 30 such that the second connector 44 is engaged with the power output port 36 and the lip 56 cooperates with the groove 55 to retain the power adapter cord on the sensor housing while the article of merchandise M is attached to the sensor housing. In any position between the three o'clock position and the nine o'clock position, the power adapter cord 40 cannot be disengaged from the power output port 36 or decoupled from the retaining means 50 of the sensor housing 30 as long as the article of merchandise M remains attached to the upper surface 31 of the sensor housing such that the rear surface R prevents further rotation of the power adapter cord towards the twelve o'clock position.

Figure 7:
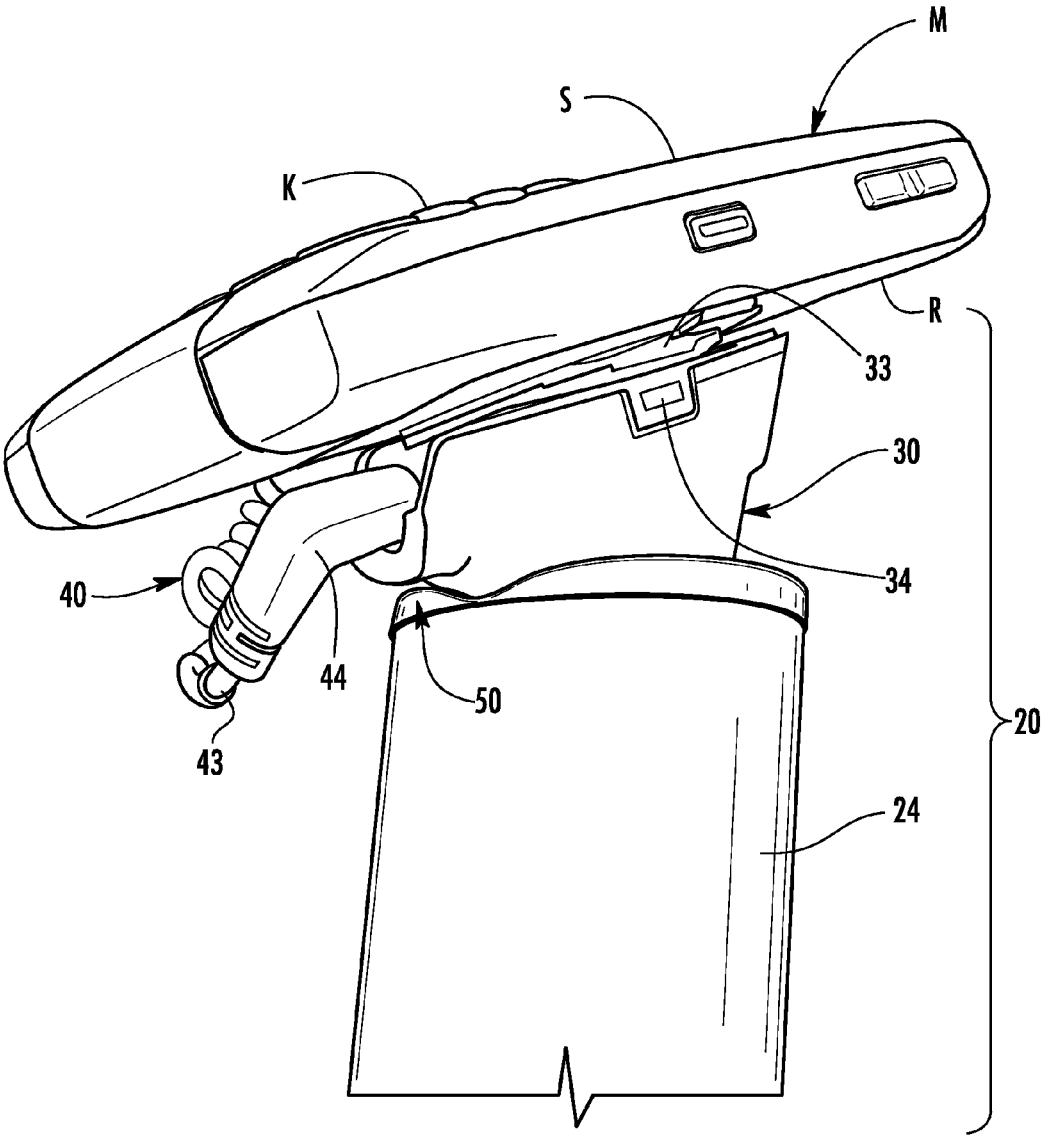
FIG. 7 is another perspective view of the merchandise display security device of FIG. 1 illustrating the handheld electronic article of merchandise attached to the sensor housing with the power adapter cord being retained on the sensor housing.

FIG. 7 shows the merchandise display security device 20 with the article of merchandise M attached to the sensor housing 30 and the power adapter cord 40 retained on the sensor housing by the retaining means 50. As previously mentioned, the sensor housing 30 is removably supported on the pedestal portion 24 of the security device 20 and the article of merchandise M is attached to the sensor housing 30 by a thin layer of a double-sided pressure sensitive adhesive (PSA) 33, for example double-sided tape. A helical coil cable 35 shown in FIGS. 2-6 contains at least a pair of conductors electrically connected at one end to an internal or external power source and electrically connected at the other end to the power output port 36 disposed on the outer periphery of the sensor housing 30. The power adapter cord 40 contains at least a pair of conductors 45 that are electrically connected to the corresponding pair of conductors of the helical coil cable 35 at the power output port 36 through the second connector 44 at the second end 43 of the power adapter cord. The conductors 45 of the power adapter cord 40 are electrically connected to the article of merchandise M through the first connector 42 at the first end 41 of the power adapter cord. As such, the power adapter cord 40 functions to provide electrical power from the internal or external power source to the article of merchandise M. As previously described, the retaining means 50, and more particularly the groove 55 defined by the shelf 52 and outer wall 54 of the retaining means, cooperates with the lip 56 formed on the second connector 44 to retain the power adapter cord 40 on the sensor housing 30 when the article of merchandise is attached to the sensor housing since the power adapter cord cannot be rotated to an engaged, but uncoupled position. As such, the retaining means 50 prevents the power adapter cord 40 from being disengaged to interrupt power to the article of merchandise M. At the same time, the retaining means 50 prevents the power adapter cord from being decoupled from the sensor housing 30 and stolen or removed from a display area by an unauthorized person.

The foregoing has described one or more exemplary embodiments of a merchandise display security device for displaying and protecting an article of merchandise including means for retaining a power adapter cord on a sensor housing when the article of merchandise is attached to the sensor housing. The retaining means is operable for preventing the power adapter cord from being disengaged to interrupt power to the article of merchandise or decoupled from the sensor housing to be stolen or removed from a display area. Exemplary embodiments of a merchandise display security device and associated retaining means have been shown and described herein for purposes of illustrating and enabling the best mode of the invention. Those of ordinary skill in the art, however, will readily understand and appreciate that numerous variations and modifications of the invention may be made without departing from the spirit and scope of the invention. Accordingly, all such variations and modifications are intended to be encompassed by the appended claims.

That which is claimed is:

1. A sensor housing comprising:

a body having a surface configured for attachment to a rear surface of an article of merchandise and a power output port configured for receiving a power adapter cord to provide electrical power to the article of merchandise, the surface of the body extending within a plane, and the body including means for retaining the power adapter cord on the sensor housing with the article of merchandise attached to the surface of the body, wherein the rear surface of the article of merchandise has a larger surface area than the surface of the body, and wherein the power adapter cord comprises a connector that is L-shaped and rotatable between: (i) an engaged, but uncoupled position in which the connector extends through the plane such that the connector obstructs the article of merchandise from being attached to the surface of the body; and (ii) an engaged and coupled position in which the connector does not extend through the plane such that the article of merchandise can be attached to the surface of the body and the power adapter cord is retained on the body.

2. The sensor housing according to claim 1, wherein the means for retaining the power adapter cord comprises a shelf having an outer wall that defines a groove between the outer wall and the body.

3. The sensor housing according to claim 2, wherein the power adapter cord comprises a first connector at a first end thereof for engaging a power input port on the article of merchandise and a second connector at a second end thereof for engaging the power output port of the body.

4. The sensor housing according to claim 3, wherein the second connector has a lip formed thereon for engaging the groove between the outer wall of the shelf and the body.

5. The sensor housing according to claim 1, further comprising a cable having at least a pair of conductors for electrically connecting the power output port to a source of electrical power.

6. The sensor housing according to claim 5, wherein the power adapter cord comprises at least a pair of conductors that are electrically connected to the pair of conductors of the cable at the power output port of the body to provide electrical power to the article of merchandise.

7. The sensor housing according to claim 6, wherein the power adapter cord comprises a first connector at a first end thereof for engaging a power input port on the article of merchandise and a second connector at a second end thereof for engaging the power output port of the body.

8. A sensor housing comprising:

a body having a surface configured for attachment to a rear surface of an article of merchandise and a power output port configured for receiving a power adapter cord to provide electrical power to the article of merchandise, the surface of the body extending within a plane; and a shelf disposed on the body adjacent the power output port, the shelf having an outer wall that defines a groove between the outer wall and the body configured for cooperating with a connector of the power adapter cord;

wherein the rear surface of the article of merchandise has a larger surface area than the surface of the body, wherein the power adapter cord is retained on the sensor housing when the connector of the power adapter cord cooperates with the groove and the article of merchandise is attached to the body, and wherein the connector is L-shaped and rotatable between: (i) an engaged, but uncoupled position in which the connector extends through the plane such that the connector obstructs the article of merchandise from being attached to the surface of the body; and (ii) an engaged and coupled position in which the connector does not extend through the plane such that the article of merchandise can be attached to the surface of the body and the power adapter cord is retained on the body.

9. The sensor housing according to claim 8, wherein the connector has a lip formed thereon that is rotatably disposed within the groove.

10. The sensor housing according to claim 8, wherein the power adapter cord comprises a first connector at a first end thereof configured to engage a power input port provided on the article of merchandise and a second connector at a second end thereof configured to engage the power output port of the body.

11. The sensor housing according to claim 10, further comprising a cable having at least a pair of conductors extending between a source of electrical power and the power output port and wherein the power adapter cord has at least a pair of conductors extending between the first connector and the second connector such that electrical power is provided to the article of merchandise with the first connector of the power adapter cord engaging the power input port of the article of merchandise and the second connector engaging the power output port of the body.

12. The sensor housing according to claim 9, wherein the connector of the power adapter cord is rotatably disposed within the groove between an engaged, but uncoupled position in which the lip is not disposed within the groove and an engaged and coupled position in which the lip is disposed within the groove.

13. A method of retaining a power adapter cord for providing electrical power to an article of merchandise on a sensor housing, the method comprising:

providing a sensor housing comprising a body having a surface configured for attachment to a rear surface of the article of merchandise and a power output port, the surface of the body extending within a plane, the rear surface of the article of merchandise having a larger surface area than the surface of the body, the body further having an outer wall adjacent the power output port that defines a groove for cooperating with an L-shaped connector of the power adapter cord;

positioning the connector of the power adapter cord adjacent the power output port in an engaged, but uncoupled position in which the connector extends through the plane such that the connector obstructs the article of merchandise from being attached to the surface of the body;

rotating the connector of the power adapter cord from the engaged, but uncoupled position to an engaged and coupled position wherein the connector of the power adapter cord does not extend through the plane and the connector of the power adapter cable is disposed within the groove; and attaching the article of merchandise to the surface of the body with the connector of the power adapter cord in the engaged and coupled position such that the connector of the power adapter cord is retained within the groove.

14. The method according to claim 13, wherein the power adapter cord has a first connector at a first end thereof configured for engaging a power input port on the article of merchandise and a second connector at a second end thereof configured for engaging the power output port of the body.

15. The method according to claim 14, wherein the sensor housing further comprises a cable having a pair of conductors electrically connecting the power output port to a source of electrical power and wherein the power adapter cord has a pair of conductors electrically connecting the power input port of the article of merchandise to the power output port of the body when the first connector is engaged with the power input port and the second connector is engaged with the power output port.

16. A merchandise display security device for an article of merchandise comprising:

a power adapter cord for providing electrical power to the article of merchandise from a source of electrical power, the power adapter cord having a first connector at a first end thereof configured for engaging a power input port provided on the article of merchandise and a second connector at a second end thereof; and a sensor housing having a surface configured for attachment to a rear surface of the article of merchandise and a power output port configured for engaging the second connector at the second end of the power adapter cord, the surface of the body extending within a plane;

wherein the rear surface of the article of merchandise has a larger surface area than the surface of the sensor housing, wherein the power adapter cord is retained on the sensor housing when the second connector at the second end of the power adapter cord is engaged with the power output port of the sensor housing and the article of merchandise is attached to the sensor housing, and wherein the second connector is L-shaped and rotatable between: (i) an engaged, but uncoupled position in which the second connector extends through the plane such that the second connector obstructs the article of merchandise from being attached to the surface of the body; and (ii) an engaged and coupled position in which the connector extends away from the surface of the body such that the article of merchandise can be attached to the surface of the body and the power adapter cord is retained on the body.

17. The merchandise display security device according to claim 16, wherein the sensor housing comprises a body and an outer wall adjacent the power output port that defines a groove between the outer wall and the body for receiving a portion of the power adapter cord.

18. The merchandise display security device according to claim 17, wherein the portion of the power adapter cord comprises a lip formed on the second connector at the second end of the power adapter cord and wherein the lip is disposed within the groove to retain the power adapter cord on the sensor housing when the article of merchandise is attached to the sensor housing.

19. The merchandise display security device according to claim 18, wherein the second connector of the power adapter cord is rotatable between an engaged, but uncoupled position in which the lip is not disposed within the groove and an engaged and coupled position in which the lip is disposed within the groove.

20. The merchandise display security device according to claim 16, wherein the sensor housing further comprises a cable having at least a pair of conductors extending between a source of electrical power and the power output port and wherein the power adapter cord has at least a pair of conductors extending between the first connector and the second connector such that electrical power is provided to the article of merchandise with the first connector of the power adapter cord engaging the power input port of the article of merchandise and the second connector engaging the power output port of the sensor housing.

21. The sensor housing according to claim 1, wherein the connector is configured to rotate about an axis that is substantially parallel to the plane.

22. The sensor housing according to claim 9, wherein the lip is positioned opposite the shelf relative to an axis of rotation of the connector in the engaged, but uncoupled position.

23. The sensor housing according to claim 1, wherein the means for retaining the power adapter cord is disposed outwardly of the surface configured for attachment to the article of merchandise.

24. The sensor housing according to claim 1, wherein the connector is rotatable 90° to 180° from the engaged, but uncoupled position to the engaged and coupled position.

* * * * *